US007435091B1

(12) United States Patent
Cruz

(10) Patent No.: US 7,435,091 B1
(45) Date of Patent: Oct. 14, 2008

(54) ROTATING ELECTRICAL POWER PLUG ADAPTER

(75) Inventor: Felix Cruz, 40 Irving St., Montclair, NJ (US) 07042

(73) Assignee: Felix Cruz, Montclair, NJ (US)

( * ) Notice: Subject to any disclaimer, the term of this patent is extended or adjusted under 35 U.S.C. 154(b) by 0 days.

(21) Appl. No.: 12/002,698

(22) Filed: Dec. 18, 2007

(51) Int. Cl.
*H01R 39/00* (2006.01)

(52) U.S. Cl. ..... 439/18; 439/954

(58) Field of Classification Search ..... 439/11–30, 439/539, 954
See application file for complete search history.

(56) References Cited

U.S. PATENT DOCUMENTS 2,459,032 A * 1/1949 Korth ..... 439/29
4,583,798 A * 4/1986 Blazowich ..... 439/24
5,967,815 A * 10/1999 Schlessinger et al. ..... 439/188
6,068,490 A * 5/2000 Salzberg ..... 439/25
6,638,074 B1 * 10/2003 Fisher ..... 439/22
7,121,834 B2 * 10/2006 Gerard ..... 439/21
7,238,028 B2 * 7/2007 Gerard ..... 439/21

* cited by examiner

*Primary Examiner*—James Harvey

(57) ABSTRACT

A novel stand alone electrical rotating power plug adapter device is disclosed herein which will increase the number of power cords that can be connected to wall outlets, power strips, or multi outlet plugs. The invention presented herein, addressing the object of creating a stand alone rotating electrical power plug adapter device with fixed external prongs, which can be inserted into sockets in wall outlets or power strips and a rotating electrical socket section which accepts prongs of power plugs.

1 Claim, 6 Drawing Sheets

ROTATING ELECTRICAL POWER PLUG ADAPTER

BACKGROUND OF THE INVENTION

1. Field of the Invention This invention relates to electrical adapters and more in particular to a novel stand alone rotating electrical power plug adapter which comprises of a front surface which rotates and contains electrical sockets and a back surface which is fixed and contains electrical prongs.

2. Description of prior art

At this time period there are no existing stand alone rotating electrical power plug adapters. The existing electrical adapters are of Type I or Type II. Type I adapters allow the male section (prongs) of the adapter to be inserted into electrical sockets of an electrical system that is different from the electrical system that the female section, sockets, of the adapters is designed to accept. Type II electrical adapters are usually designed to be used on one type of electrical system and can be referred to as 2-to-3 adapters. These adapters are used when wall outlets contain only two electrical sockets and power cords contain three prongs. In this case, the three prongs of a plug are inserted into the three sockets of the 2-3 adapter and the two prongs of the 2-3 adapter are inserted into the two electrical sockets of the wall outlet.

BRIEF SUMMARY OF THE INVENTION

The invention presented herein, addressing the object of creating a stand alone rotating electrical power plug adapter with fixed external prongs, which can be inserted into sockets in wall outlets or power strips and a rotating electrical socket section which accepts prongs of power cords. A second object of this novel invention is to permit more electrical plugs, than what is possible today, to be connected to power strips, wall outlets, or multi-plug outlets.

DETAIL DESCRIPTION OF THE INVENTION

Figure 1:
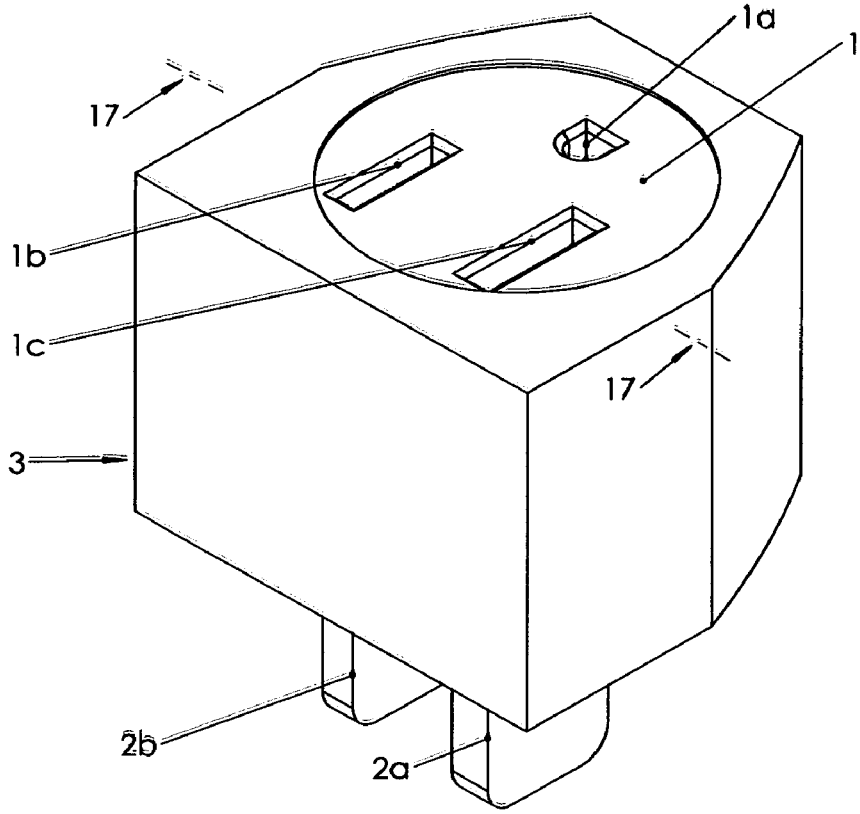
FIG. 1 is a perspective top view of the electrical power plug adapter device.
Figure 2:
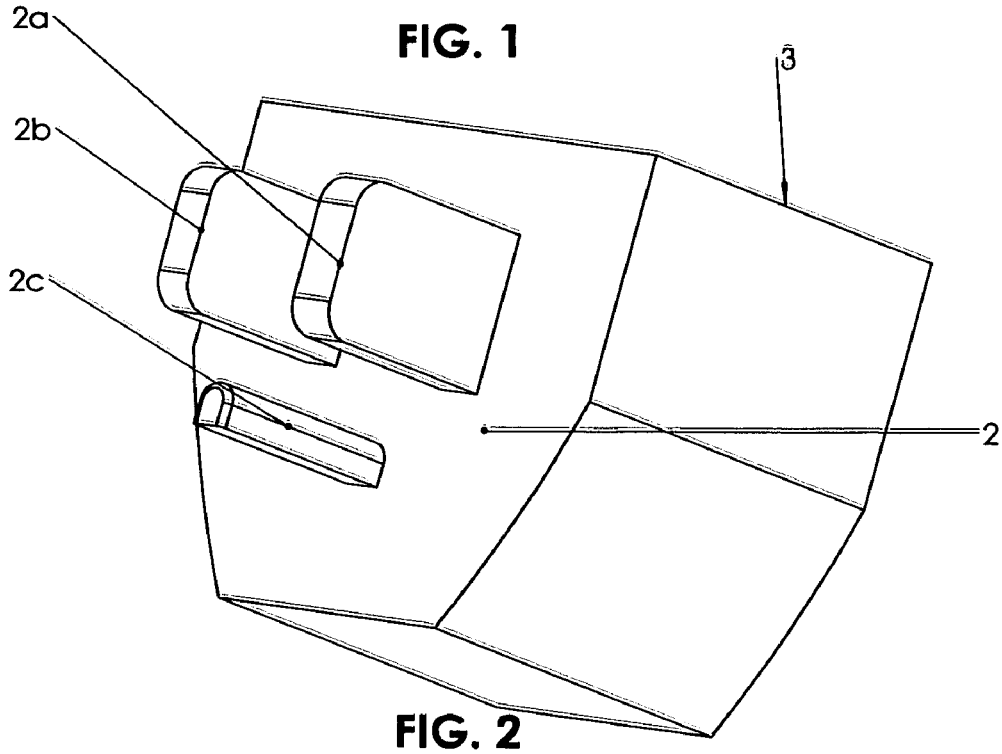
FIG. 2 is a perspective bottom view of the electrical power plug adapter device.
Figure 3:
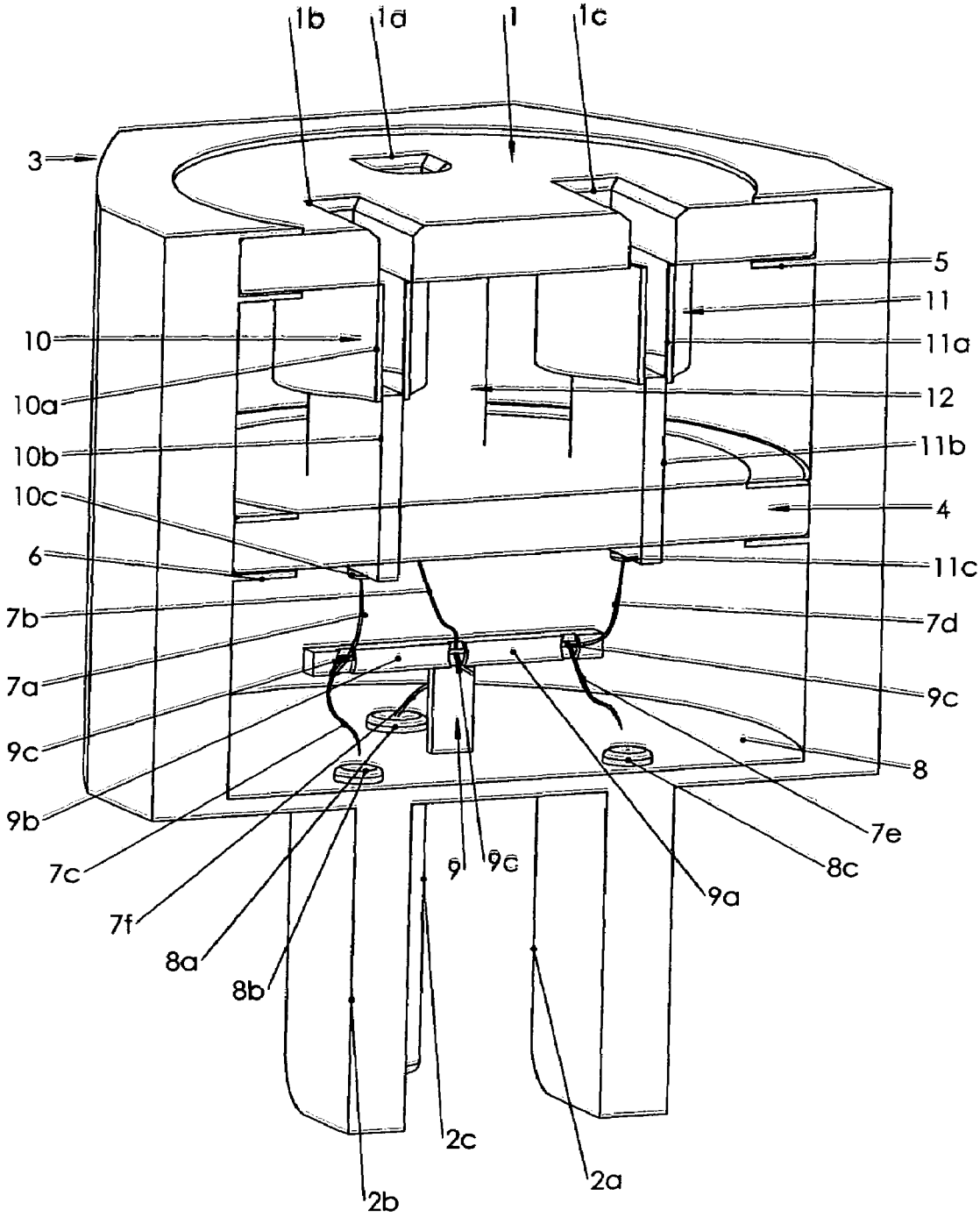
FIG. 3 is a perspective cross-section on the line 17-17 of FIG. 1 of the front inside of the electrical power plug adapter device.
Figure 4:
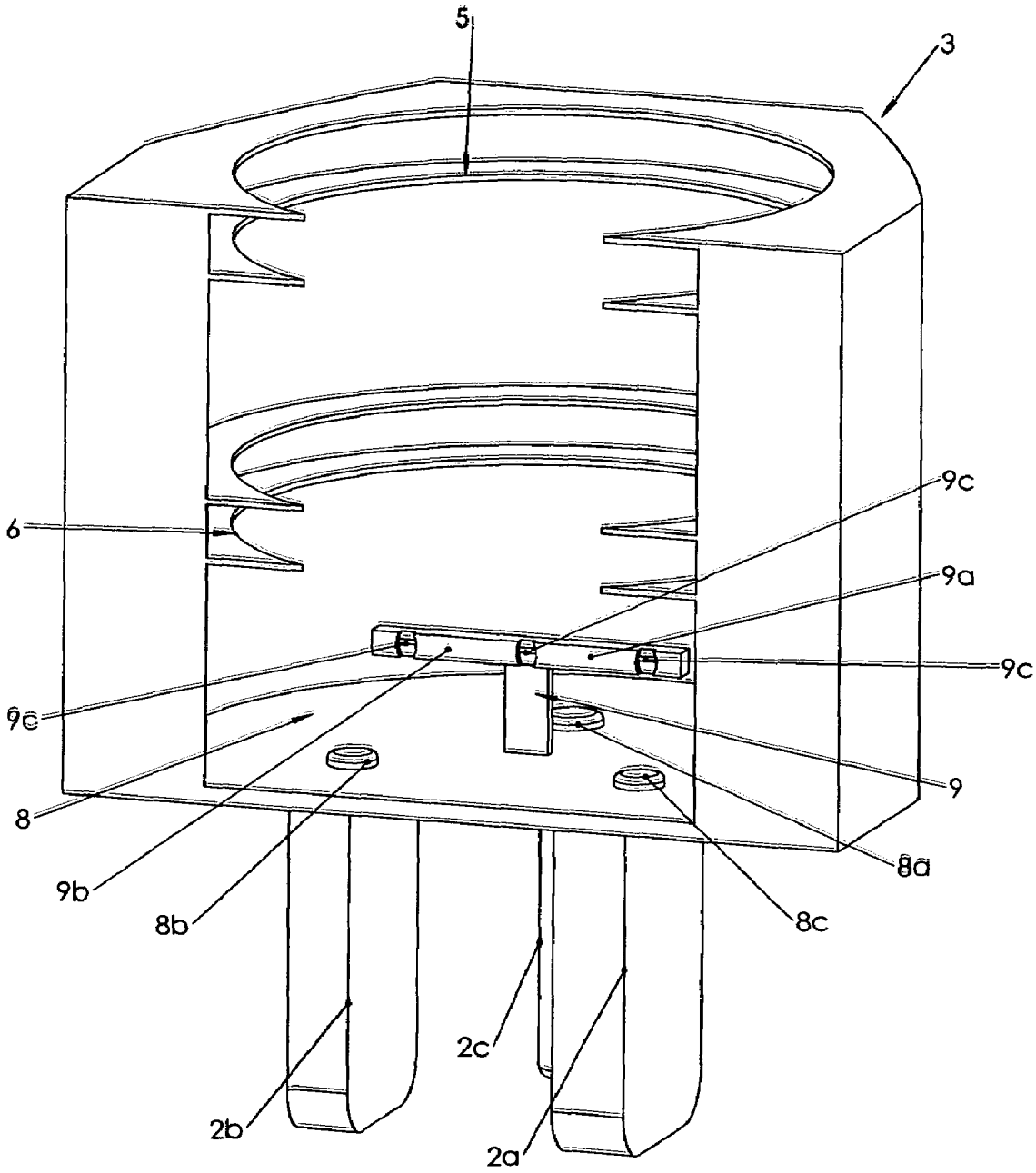
FIG. 4 is a perspective sectional view, shown on FIG. 3, of the front inside of the rotating power plug adapter device showing only the parts that are permanently attached to the interior surfaces.
Figure 5:
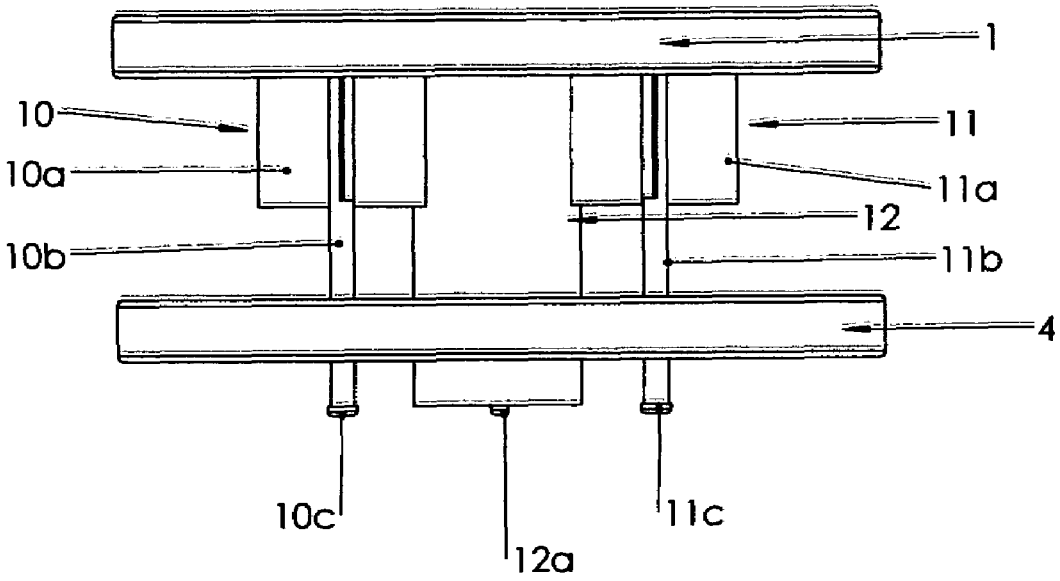
FIG. 5 is an elevation view only of the moving parts, the front and middle disks and the electrical plates which connect the two disks together.
Figure 6:
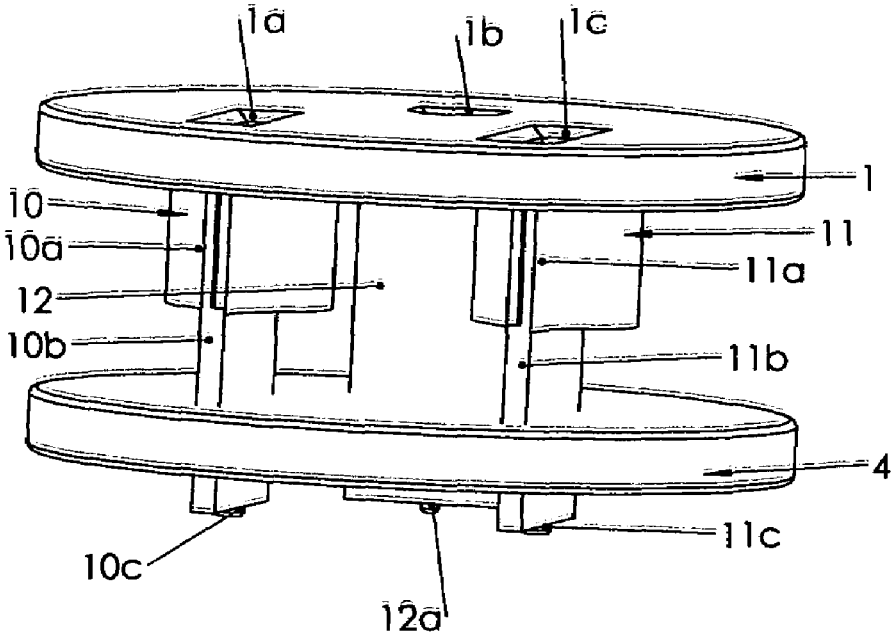
FIG. 6 is a perspective view only of the moving parts, the front and midle disks and the electrical plates which connect the disks together.

Referring now to FIG. 1 through FIG. 6 there is shown an electrical rotating power plug adapter device 3 comprised of a front disk 1 containing electrical sockets (1*a*, 1*b*, 1*c*) and a back surface 2 containing external electrical prongs (2*a*, 2*b*, 2*c*). FIG. 3 shows all the parts of the novel electrical power plug adapter device, the internal parts that move (1, 4, 7*a*, 7*b*, 7*d*) and the stationary parts (5, 6, 9). FIG. 3 also shows the front 1 and middle 4 disks connected together by vertical electrical plates (10, 11, 12) and the upper and middle circular channels (5, 6) which allow the front and middle disks (1, 4) to rotate in unison. The electrical plates (10, 11, 12) are connected to the bottom interior surface of front disk 1 and extend through top surface of middle disk 4 (FIG. 5) and protrude outward (FIG. 6) on the bottom surface (10*c*, 11*c*, 12*a*). This allows middle disk 4 to rotate in the same direction as front disk 1. The wire support structure 9 (FIG. 4) is comprised of a vertical member which is attached to the bottom interior 8 of body 3 and a horizontal member split into two sections (9*a*, 9*b*). Located on horizontal sections (9*a*, 9*b*) are three identical vertical grooves 9*c* which act as restrains, a pivot point, and prevent section of wires (7*c*, 7*e*, 7*f*) located below horizontal sections (9*a*, 9*b*) from moving (FIG. 3). However, wire sections (7*a*, 7*b*, 7*d*), whose lengths are above horizontal sections (9*a*, 9*b*) and connected to the bottom of disk 4 at three points (10*c*, 12*a*, 11*c*) will rotate in the same direction as front and middle disks (1, 4).

Figure 7:
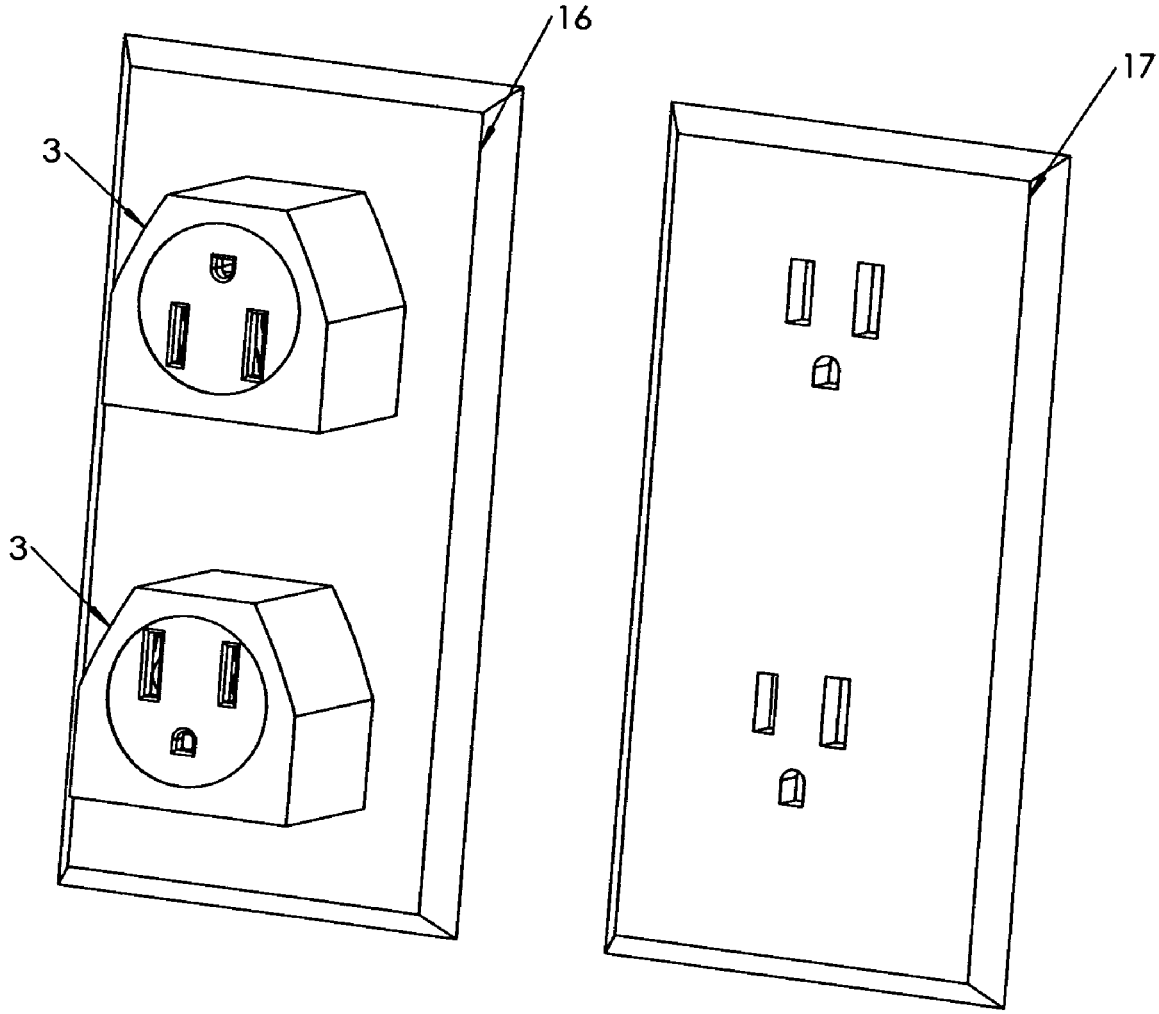
FIG. 7 is perspective view of two outlets with one outlet having two power plug devices connected with their ground sockets in opposite orientations.
Figure 8:
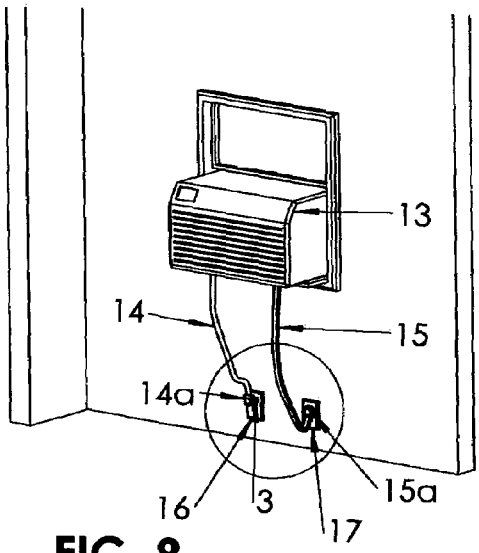
FIG. 8 is a perspective view of power plug devices connected to two power cords of a window air conditioner.
Figure 9:
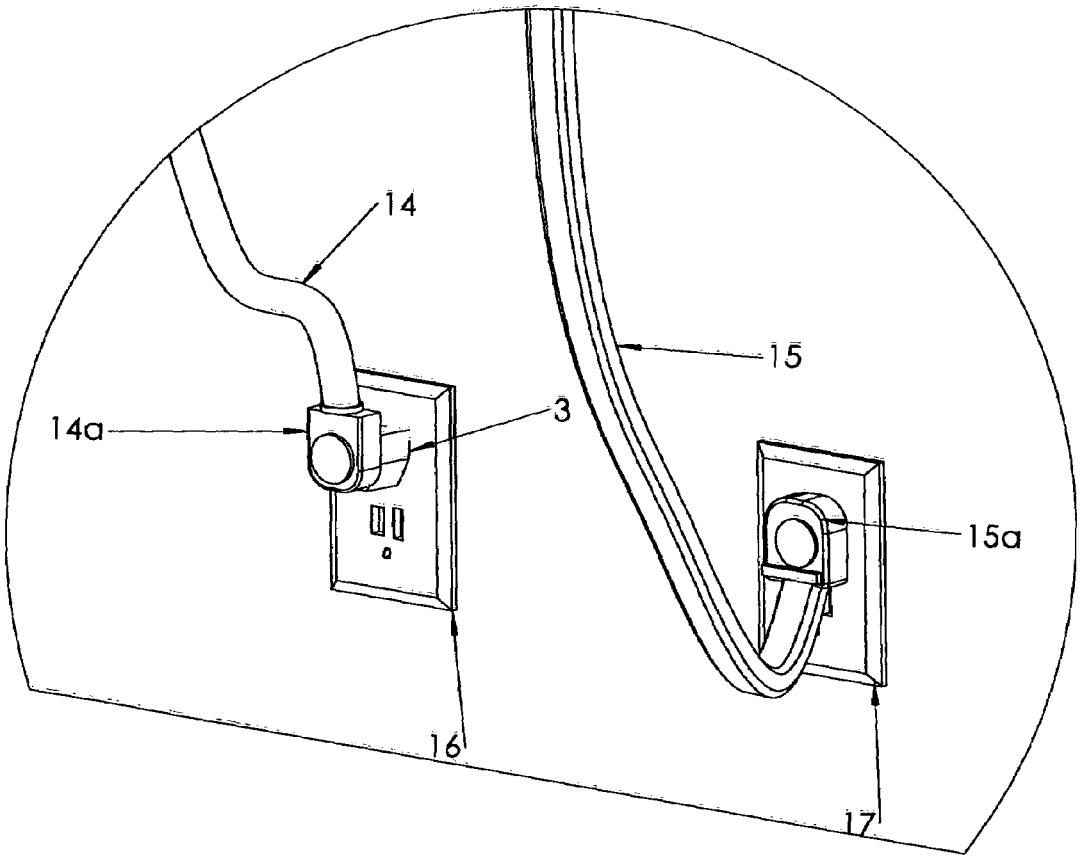
FIG. 9 is a magnified perspective view of the two electrical power plug devices, in FIG. 8, connected to two different wall outlets and two power cords connected to the power plug devices.

Referring now to FIG. 7 through FIG. 9 to best describe the utility of this novel invention. Two electrical power plug adapters are shown connected to wall outlet 16 with their ground sockets oriented in different directions by rotating front disk 1 in FIG. 8 shows the power plugs (14*a*, 15*a*) of two power cords (14, 15), of the air-conditioning unit connected to two power plug adapter devices which in turn are connected to the electrical sockets of two adjacent wall outlet. The electrical connection illustrates how the bottom receptacles of outlet 17 can't be used to connect a different power cord unless the power plug device is oriented in the proper direction as it is shown in outlet 16. The advantage of using the power plug adapter device is that it will allow more power cords to be connected to wall outlets or power strips because it changes the orientation of the ground socket and thereby will free space to allow more power cords to be connected.

I claim:

1. A stand alone rotating electrical power plug adapter device having a body and comprising: a circular rotating front disk supported and held in place by upper circular channel structure attached to internal side walls of said body; said front disk with multiple electrical socket openings on front outer surface and electrical plates attached to internal back surface; internal circular rotating middle disk, permanently connected to said front disk via electrically conductive plates, supported and held in place by middle circular channel structure attached to internal side walls of said body; said electrically conductive plates attached to internal back surface of said front disk, penetrating through said middle disk and ending a specified distance away from the bottom surface of said middle rotating disk; T shaped wire support structure in which bottom surface of vertical section is attached to interior bottom surface of said body; said wire support structure having grooves on front surface of horizontal section of said T shaped structure; electrical wires with ends attached to bottom internal surface of said body, other wires' ends connected to ends of said electrical plates protruding outward from bottom surface of said middle disk, and wires inserted, at a point half the length of the wires, within said grooves of T shaped structure; external electrical prongs protruding outward from bottom surface of said rotating electrical power plug adapter device body and attached internally to said ends of wires connected at bottom of internal surface of said body.

* * * * *